US006499740B2

(12) United States Patent
Yiu

(10) Patent No.: US 6,499,740 B2
(45) Date of Patent: Dec. 31, 2002

(54) SCORE RING STRUCTURE FOR DART BOARDS

(76) Inventor: Chih-Hao Yiu, 7-1 Floor, No. 30, Lin-Sen Rd., Taichung City (TW)

( * ) Notice: Subject to any disclaimer, the term of this patent is extended or adjusted under 35 U.S.C. 154(b) by 0 days.

(21) Appl. No.: 09/768,484

(22) Filed: Jan. 25, 2001

(65) Prior Publication Data

US 2002/0096830 A1 Jul. 25, 2002

(51) Int. Cl.[7] ..... F41J 3/00
(52) U.S. Cl. ..... 273/403; 273/374; 273/371
(58) Field of Search ..... 273/371, 374–376, 273/403, 408

(56) References Cited

U.S. PATENT DOCUMENTS 4,239,573 A * 12/1980 Wu ..... 156/245
5,676,379 A * 10/1997 Kicks ..... 273/403
5,788,244 A * 8/1998 Hui et al. ..... 273/374
5,848,792 A * 12/1998 Brejcha ..... 273/376
5,897,116 A * 4/1999 Yiu ..... 273/376
6,047,968 A * 4/2000 Lu et al. ..... 273/371
6,089,571 A * 7/2000 Cho ..... 273/371

FOREIGN PATENT DOCUMENTS

GB 2202162 * 9/1988
GB 2247629 * 11/1992

* cited by examiner

*Primary Examiner*—Mark S. Graham
(74) *Attorney, Agent, or Firm*—Charles E. Baxley

(57) ABSTRACT

A score structure for a dart board includes a frame with at least three sides and one of the at least three sides is an inward curved side. A body member is received in the frame and the inward curved side urges one of sides of the body member to let the body member be snugly received in the frame.

1 Claim, 8 Drawing Sheets

SCORE RING STRUCTURE FOR DART BOARDS

FIELD OF THE INVENTION

The present invention relates to a dart board wherein each score ring includes a frame receiving a body member. The frame has at least one urging side to secure the body member in the frame.

BACKGROUND OF THE INVENTION

A conventional dart board 10 is shown in FIGS. 7 and 8 and generally includes a plurality of circular frames 111 and a plurality of radial ribs 112 which connects the circular frames 111 to be a disk-like structure with a plurality of openings defined by the circular frames 111 and the radial ribs 112. Each opening has a score ring 12 engaged therewith and includes a frame 121 and a body member 122 which is received in the frame 121. The shape of the frame 121 is the same as the periphery defining the opening so that every frame 121 has its unique shape to meet the periphery defining each of the openings. In order to securely insert the body member 122 in the frame 121, the specification of each frame 121 and body member 122 has to be made precisely so that there will be no gap between the frame 121 and the body member 122. This requires precise machinery and the assembling process will be slow.

The present invention intends to provide a score ring structure wherein the frame includes at least one urging side which can be deformed slightly to urge the body member in the frame.

SUMMARY OF THE INVENTION

In accordance with one aspect of the present invention, there is provided a score structure for a dart board and comprising a frame having at least three sides and one of the at least three sides is an inward curved side. A body member is received in the frame and one side of the body member is urged by the inward curved side so that the body member is matched with the at least three sides of the frame.

The primary object of the present invention is to provide a frame for snugly receiving a body member therein.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
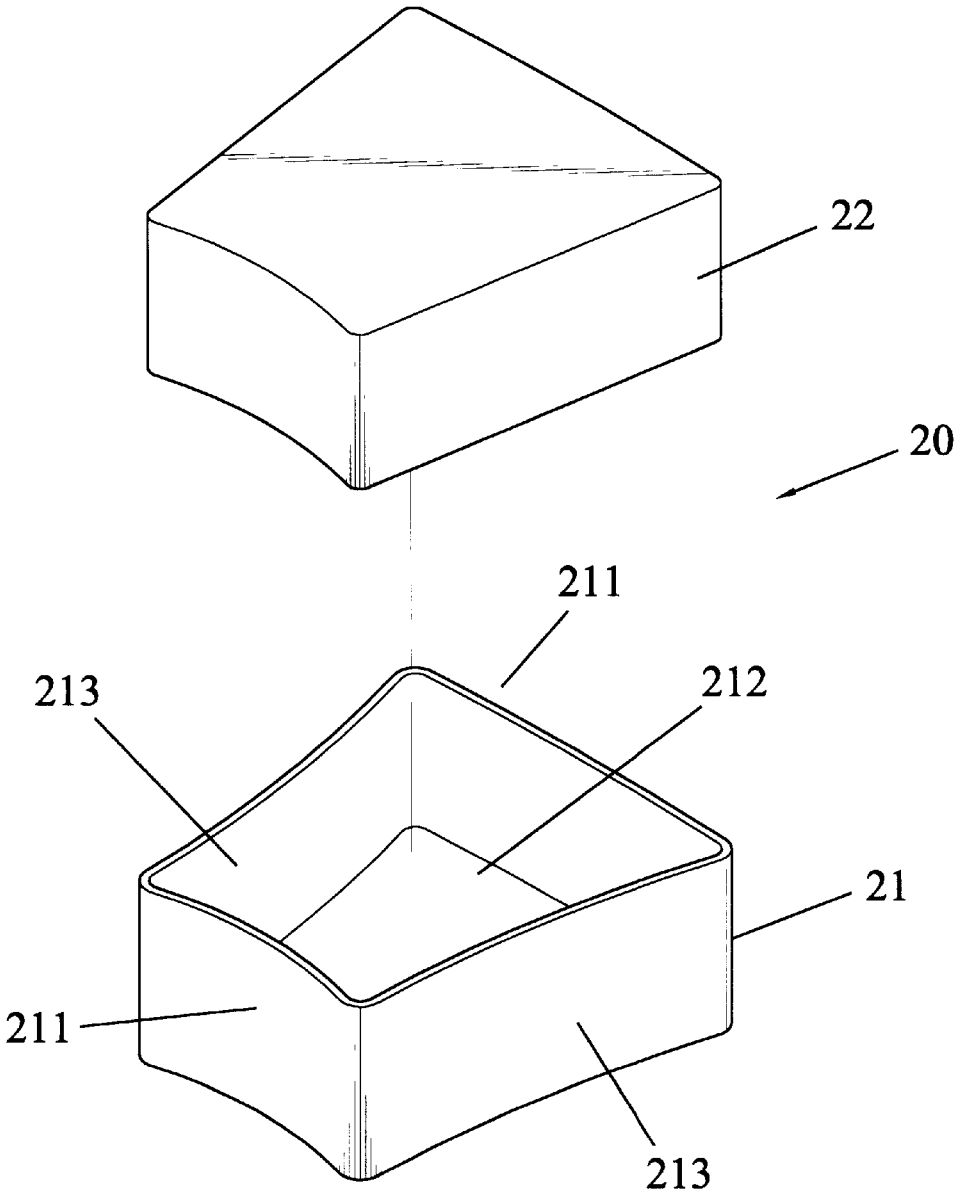
FIG. 1 is an exploded view to show a first embodiment of a frame and a body member of the score ring structure of the present invention.
Figure 2:
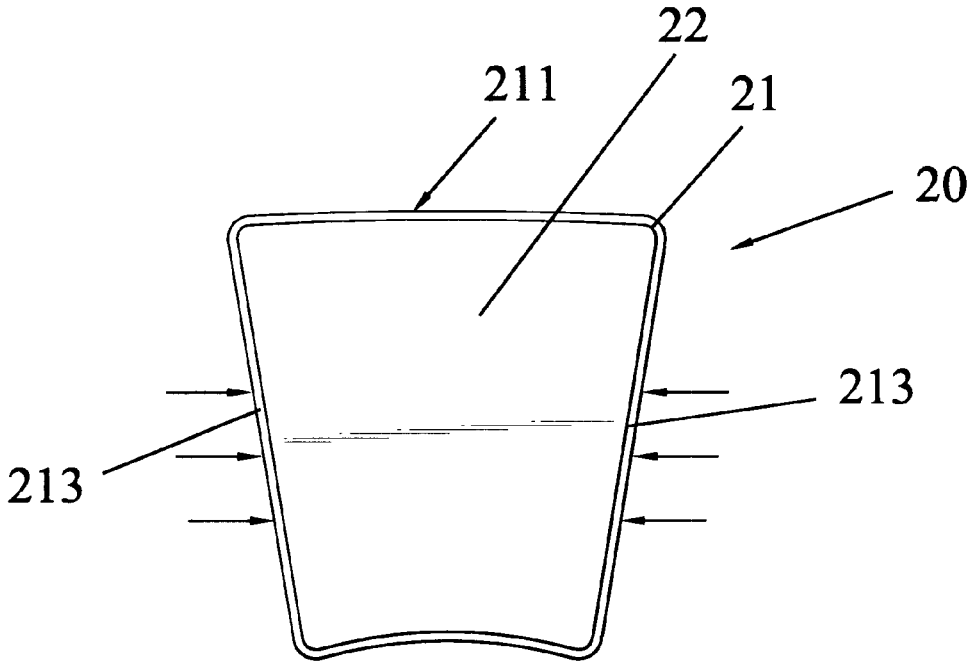
FIG. 2 is a plan view to show that two inward curved sides of the frame as shown in FIG. 1 urge two sides of the body member in the frame of the present invention.

Referring to FIGS. 1 and 2, the score ring structure 20 of the present invention comprises a four-side frame 21 having four sides which enclose a receiving space 212. A body member 22 made of paper, fibers or hays is received in the receiving space 212 in the frame 21. Two of the four sides of the frame 21 are inward curved sides 213 and the other two sides 211 are made to meet the shape of the periphery of the opening in the dart board. When the body member 22 is received in the frame 21, the two inward curved sides 213 apply a inward force to push the two sides of the body member 22 to be snugly match with the inward curved sides 213. Therefore, even if the body member 22 is not manufactured precisely to match the shape of the frame 21, the inward curved sides 213 will force the body member 22 to be secured in the frame 21.

Figure 3:
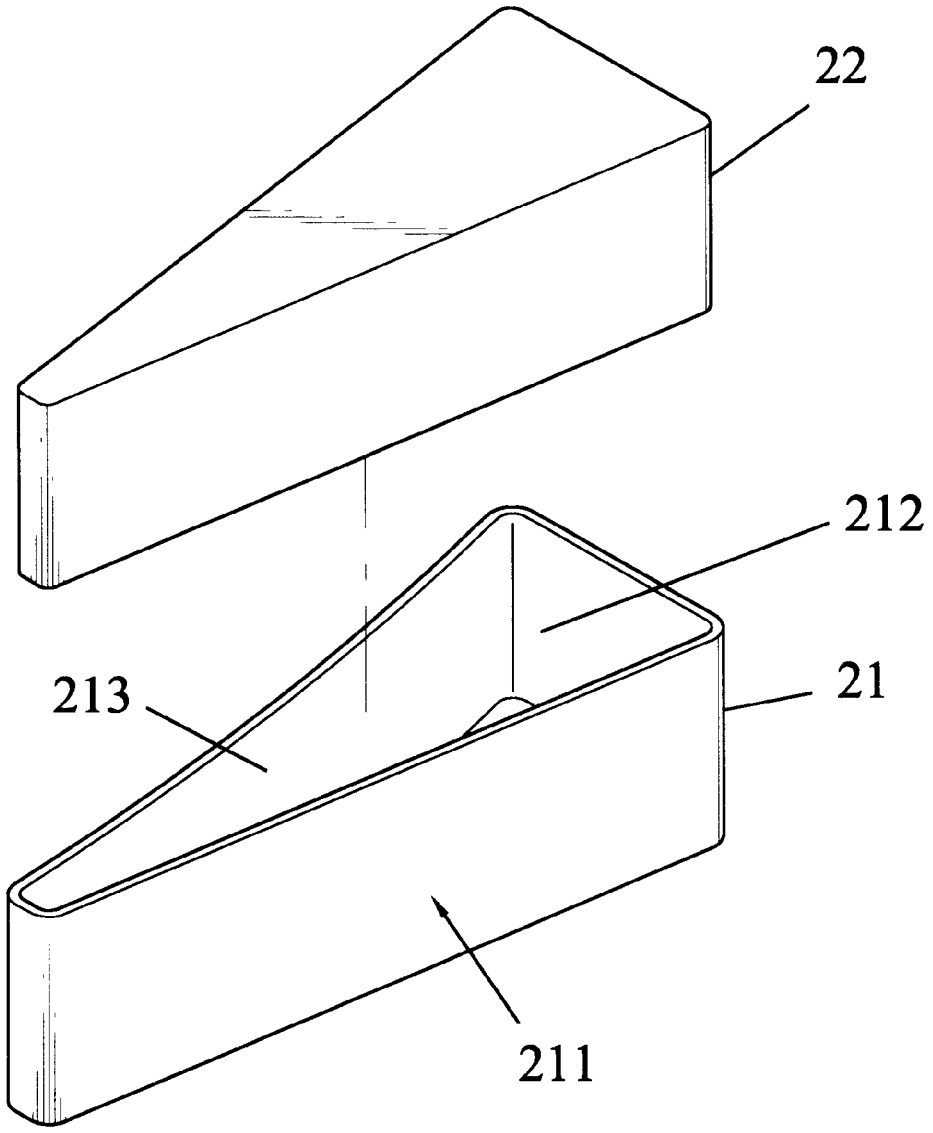
FIG. 3 is an exploded view to show a second embodiment of the frame and the body member of the score ring structure of the present invention.
Figure 4:
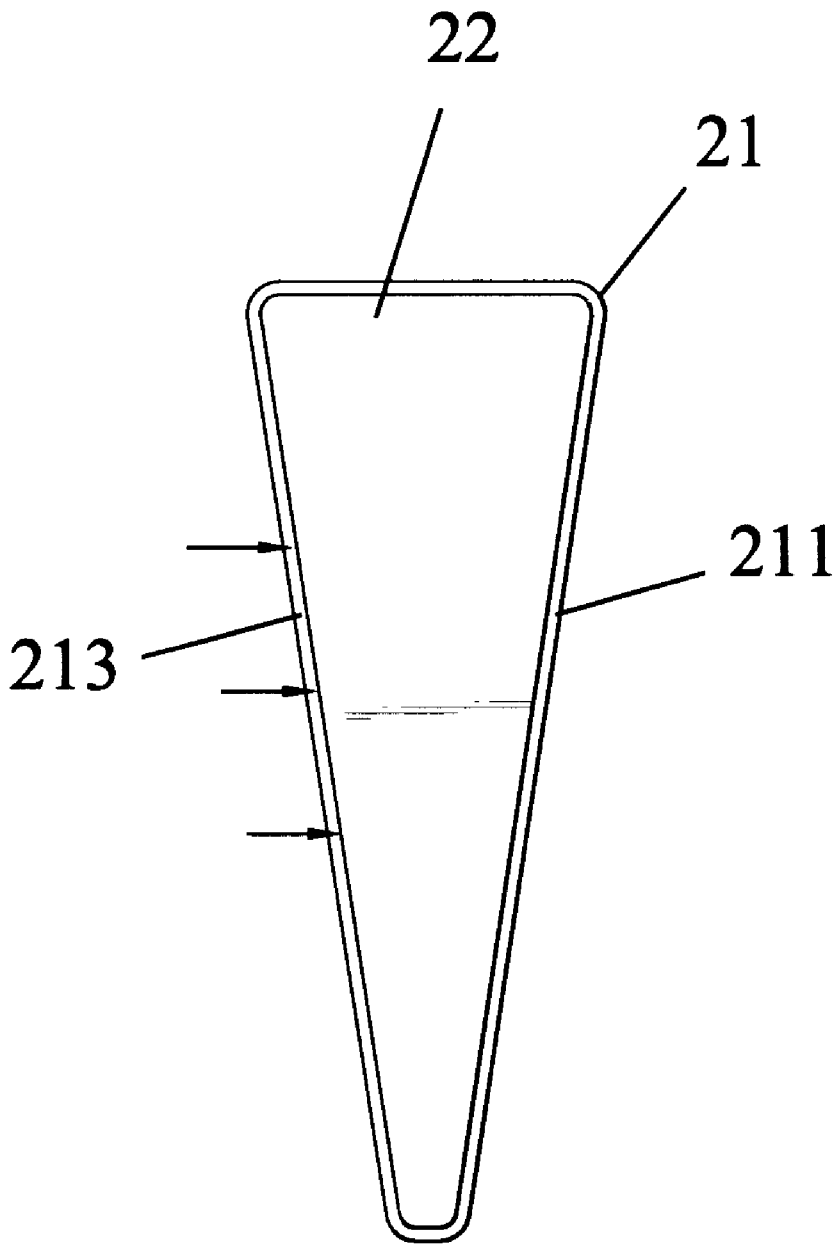
FIG. 4 is a plan view to show that one inward curved side of the frame as shown in FIG. 3 urges one side of the body member in the frame of the present invention.

FIGS. 3 and 4 show that the frame 21 can be a triangle frame with three sides 211 and one of which is an inward curved side 213. A triangular body member 22 is received in a receiving space 212 enclosed by the three sides 211, 213. The inward curved side 213 applies a force to let the body member 22 be securely received in the frame 21.

Figure 5:
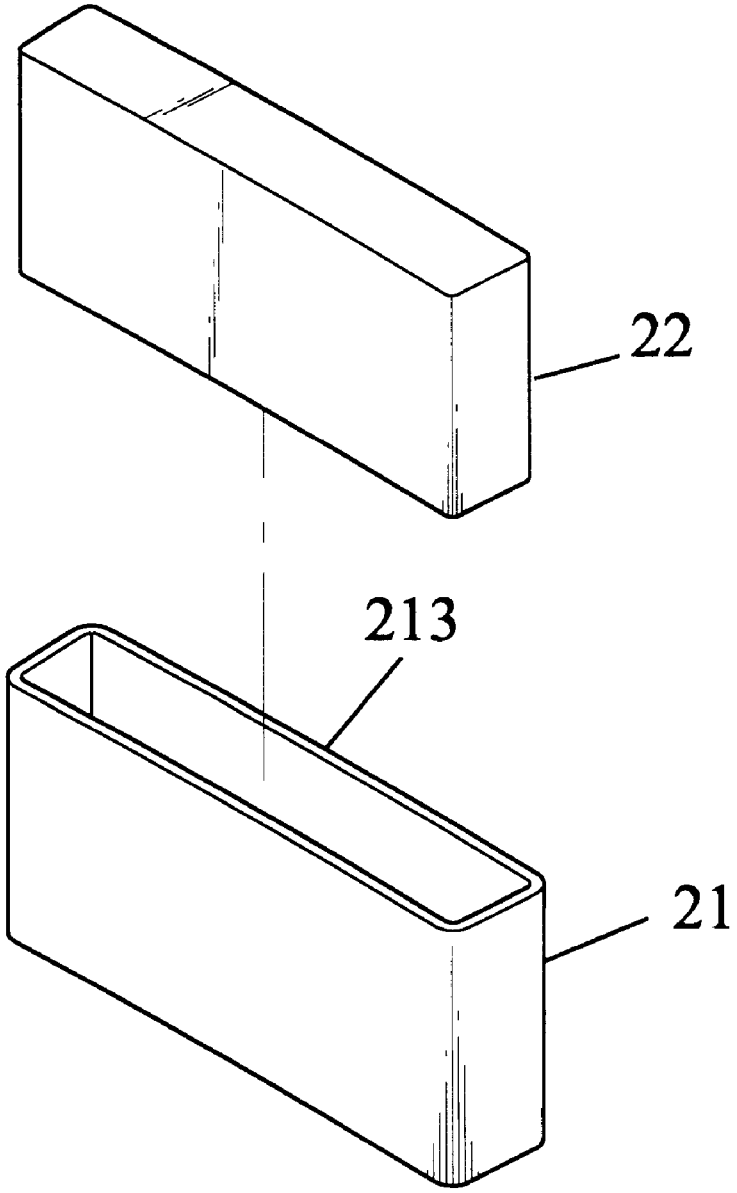
FIG. 5 is an exploded view to show a third embodiment of the frame and the body member of the score ring structure of the present invention.
Figure 6:
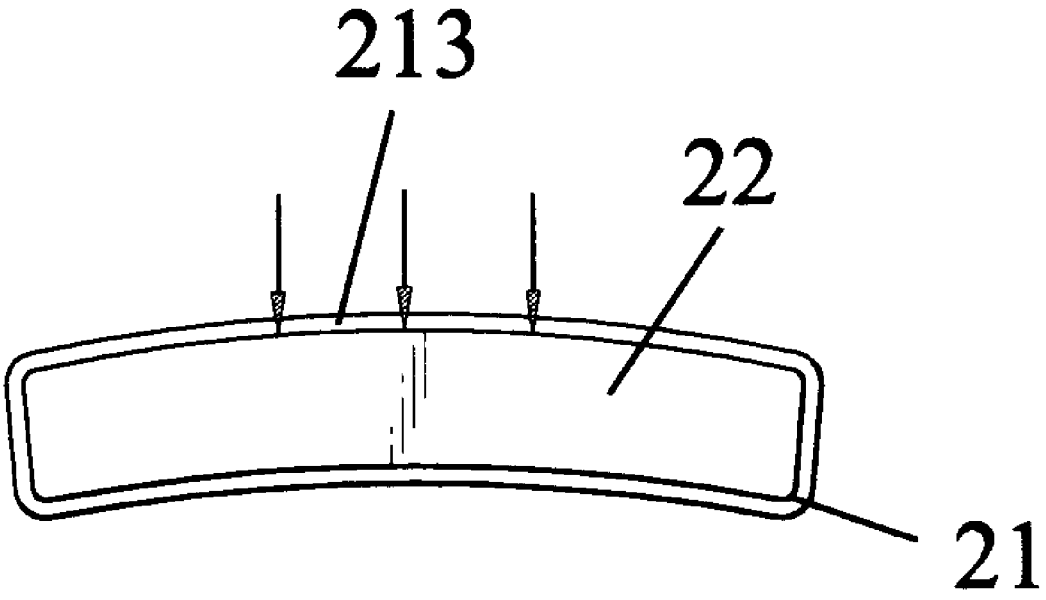
FIG. 6 is a plan view to show that one inward curved side of the frame as shown in FIG. 5 urges one side of the body member in the frame of the present invention.
Figure 7:
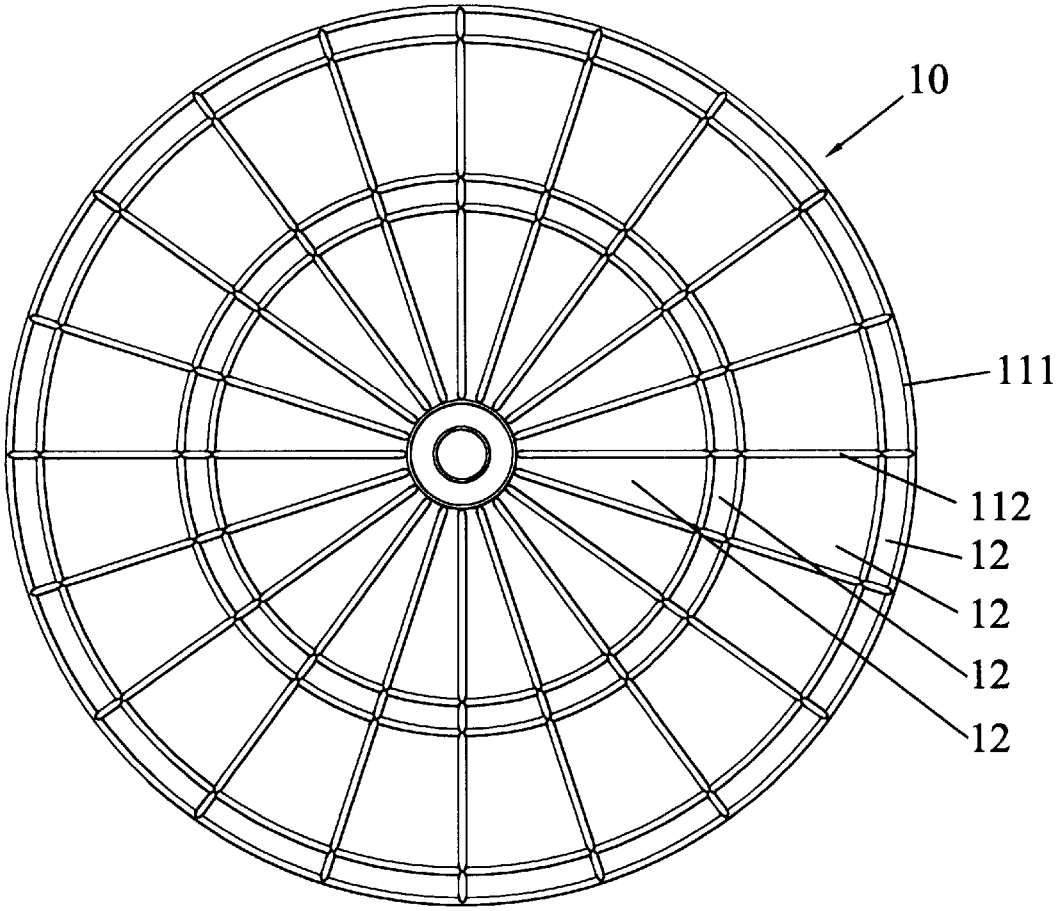
FIG.7 PRIOR ART
FIG. 7 is a plan view to show a dart board.
Figure 8:
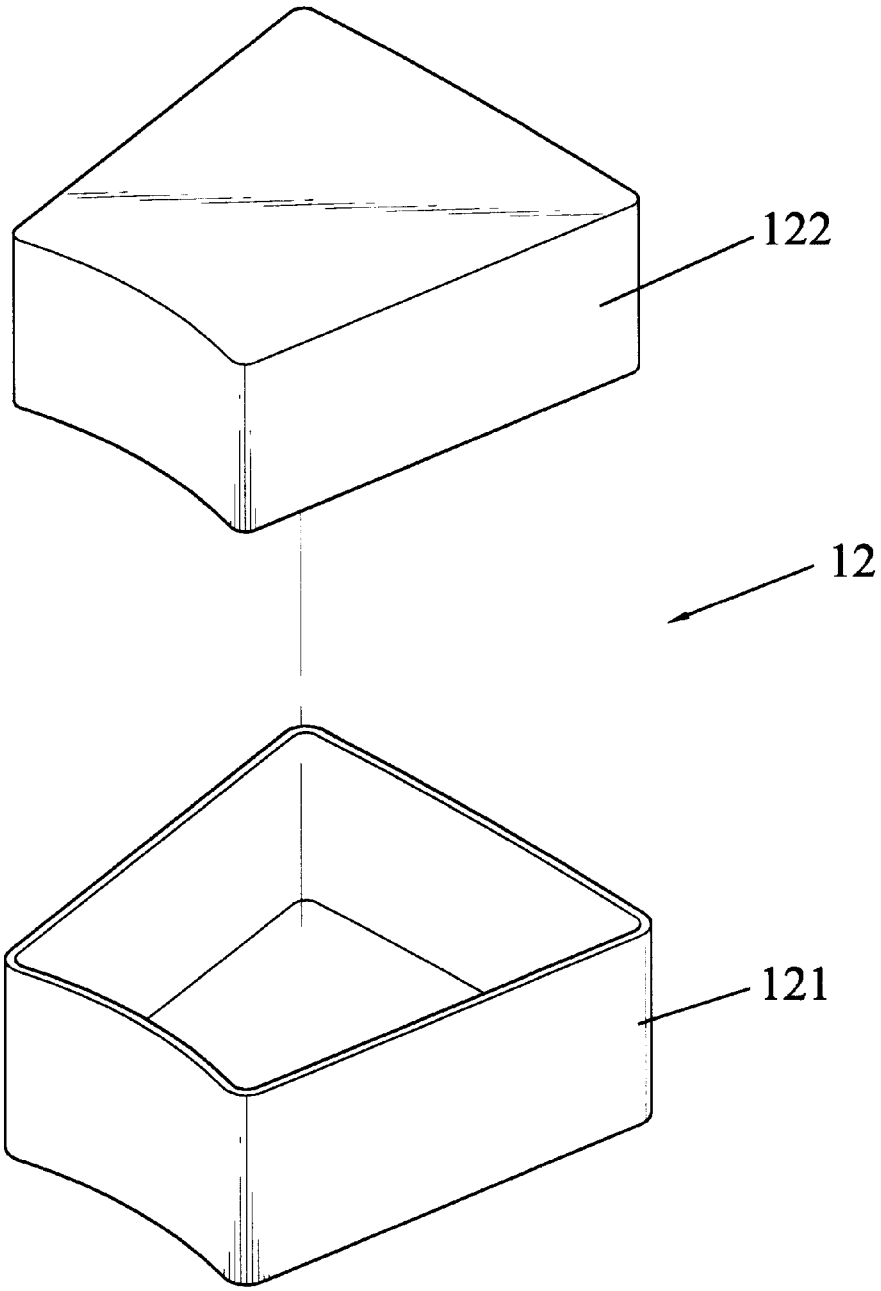
FIG.8 PRIOR ART
FIG. 8 is an exploded view to show a conventional frame and a body member of a ring structure.

FIGS. 5 and 6 show that the frame 21 is an elongate curved four-side frame and one of the two long sides is an inward curved side 213 and the body member 22 is received in the frame 21 with the inward curved side 213 urging the body member 22.

By the inward curved sides 213 of the frame 21, the body member 22 can be securely received in the frame 21 and the body member 22 does not need to be manufactured by highly precise machines.

While we have shown and described various embodiments in accordance with the present invention, it should be clear to those skilled in the art that further embodiments may be made without departing from the scope and spirit of the present invention.

What is claimed is:

1. A score structure for a dart board, the score structure being received in one of multiple openings formed by multiple annular ribs and multiple radial ribs intersecting the multiple annular ribs, the score structure including a frame, and a body member received in the frame, wherein:

the frame has at least one side wall corresponding to one of the multiple radial ribs, and the at least one side wall of the frame corresponding to one of the multiple radial ribs is formed with an inward curved clamping face urged on a flat side of the body member.

* * * * *